US007953233B2

(12) United States Patent
Holloway et al.

(10) Patent No.: US 7,953,233 B2
(45) Date of Patent: May 31, 2011

(54) SYNCHRONOUS DETECTION AND CALIBRATION SYSTEM AND METHOD FOR DIFFERENTIAL ACOUSTIC SENSORS

(75) Inventors: Peter Holloway, North Andover, MA (US); Yunhong Li, Santa Clara, CA (US); Wei Ma, San Ramon, CA (US); Peter Kamp, Rosmalen (NL)

(73) Assignee: National Semiconductor Corporation, Sunnyvale, CA (US)

( * ) Notice: Subject to any disclaimer, the term of this patent is extended or adjusted under 35 U.S.C. 154(b) by 1075 days.

(21) Appl. No.: 11/688,437

(22) Filed: Mar. 20, 2007

(65) Prior Publication Data

US 2008/0232606 A1 Sep. 25, 2008

(51) Int. Cl.
*H04R 3/00* (2006.01)

(52) U.S. Cl. ..... 381/92; 381/58; 381/91; 381/111; 381/113; 381/122; 381/356; 381/387

(58) Field of Classification Search ..... 381/91–92, 381/58, 122, 387, 111, 113, 356
See application file for complete search history.

(56) References Cited

U.S. PATENT DOCUMENTS 5,303,307 A * 4/1994 Elko et al. ..... 381/92
5,473,684 A 12/1995 Bartlett et al.
5,586,191 A 12/1996 Elko et al.
6,041,127 A 3/2000 Elko
6,385,323 B1 * 5/2002 Zoels ..... 381/313
6,449,368 B1 9/2002 Davis et al.
6,549,630 B1 4/2003 Bobisuthi
6,593,866 B1 7/2003 Eastty et al.
6,600,824 B1 7/2003 Matsuo
7,020,290 B1 3/2006 Ribic
7,035,416 B2 4/2006 Matsuo
7,123,727 B2 10/2006 Elko et al.
7,158,645 B2 1/2007 June et al.
7,561,700 B1 * 7/2009 Bernardi et al. ..... 381/92
7,676,052 B1 * 3/2010 Ma et al. ..... 381/356

FOREIGN PATENT DOCUMENTS

WO WO 2007/014136 A2 2/2007

OTHER PUBLICATIONS

International Search Report, Application No. PCT/US08/57598, dated Jul. 31, 2008, 3 pages.
Written Opinion, Application No. PCT/US08/57598, dated Jul. 31, 2008, 5 pages.
U.S. Appl. No. 11/684,076, entitled Frequency Domain Signal Processor for Close Talking Differential Microphone Array, filed Mar. 9, 2007, 24 pages.

* cited by examiner

*Primary Examiner* — Devona E Faulk
*Assistant Examiner* — Disler Paul
(74) *Attorney, Agent, or Firm* — Vedder Price, P.C.

(57) ABSTRACT

A synchronous detection and calibration system is provided for expedient calibration of differential acoustic sensors in a manufacturing and testing environment. By processing a series of sequentially received tones, respective portions of a system using differential acoustic sensors are tuned for optimum individual operation, following which corresponding control data are generated and stored for use in selecting among predetermined calibration vectors which establish and maintain optimum system operation.

12 Claims, 2 Drawing Sheets

SYNCHRONOUS DETECTION AND CALIBRATION SYSTEM AND METHOD FOR DIFFERENTIAL ACOUSTIC SENSORS

BACKGROUND OF THE INVENTION

1. Field of the Invention

The present invention relates to acoustic sensors, including microphone arrays, and in particular, to amplifier circuits for differential microphone arrays.

2. Description of the Related Art

With the seemingly ever increasing popularity of cellular telephones, as well as personal digital assistances (PDAs) providing voice recording capability, it has become increasingly important to have noise canceling microphones capable of operating in noisy acoustic environments. Further, even in the absence of excessive background noise, noise canceling microphones are nonetheless highly desirable for certain applications, such as speech recognition devices and high fidelity microphones for studio and live performance uses.

Such microphones are often referred to as pressure gradient or first order differential (FOD) microphones, and have a diaphragm which vibrates in accordance with differences in sound pressure between its front and rear surfaces. This allows such a microphone to discriminate against airborne and solid-borne sounds based upon the direction from which such noise is received relative to a reference axis of the microphone. Additionally, such a microphone can distinguish between sound originating close to and more distant from the microphone.

For the aforementioned applications, so called close-talk microphones, i.e., microphones which are positioned as close to the mouth of the speaker as possible, are seeing increasing use. In particular, multiple microphones are increasingly configured in the form of a close-talking differential microphone array (CTDMA), which inherently provide low frequency far field noise attenuation. Accordingly, a CTDMA advantageously cancels far field noise, while effectively accentuating the voice of the close talker, thereby spatially enhancing speech quality while minimizing background noise. (Further discussion of these types of microphones can be found in U.S. Pat. Nos. 5,473,684, and 5,586,191, the disclosures of which are incorporated herein by reference.)

Optimum performance of a CTDMA system using multiple microphones is obtained when all the microphones have the same frequency characteristics. However, in practice, the frequency characteristics of microphones tend to vary from each other due to process variations in their production. For example, typical electret microphones can have variations of as much as 3 dB in the telephony frequency range. The performance of a CTDMA system degrades greatly if variations among the microphones exceed a range of 0.5-1.0 dB. Thus, extra measures are needed to calibrate such variations. While technically suitable calibration systems and methods are known, they tend to be costly in terms of hardware and time needed for operation, both of which are unacceptable for use in manufacture and test of low cost consumer electronics, such as cellular telephone handsets. Additionally, existing solutions are typically implemented with one or more analog-to-digital converters (ADCs) which couple the microphones to power consuming digital signal processor (DSP) systems performing powerful signal processing algorithms that, in turn, unavoidably degrade battery operating times.

SUMMARY OF THE INVENTION

In accordance with the presently claimed invention, a synchronous detection and calibration system provides for expedient calibration of differential acoustic sensors in a manufacturing and testing environment. By processing a series of sequentially received tones, respective portions of a system using differential acoustic sensors are tuned for optimum individual operation, following which corresponding control data are generated and stored for use in selecting among predetermined calibration vectors which establish and maintain optimum system operation.

In accordance with one embodiment of the presently claimed invention, a synchronous detection and calibration system for a close-talking differential microphone array (CTDMA) includes:

a plurality of input electrodes to convey a plurality of microphone signals each of which corresponds to a source audio signal having a plurality of frequencies;

controllable amplifier circuitry coupled to the plurality of input electrodes and responsive to a plurality of amplifier control signals and the plurality of microphone signals by providing a plurality of selectively amplified signals at each of the plurality of frequencies;

controllable filter circuitry coupled to the controllable amplifier circuitry and responsive to a plurality of filter control signals and the plurality of selectively amplified signals by providing a plurality of selectively filtered signals at each of the plurality of frequencies;

signal combining circuitry coupled to the controllable filter circuitry and responsive to the plurality of selectively filtered signals by providing a combination signal at each of the plurality of frequencies, wherein the combination signal has a plurality of values each of which is related to a difference between corresponding ones of the plurality of selectively filtered signals;

synchronous signal detection circuitry coupled to one of the plurality of input electrodes and the signal combining circuitry, and responsive to one of the plurality of microphone signals and the combination signal by providing an error signal indicative of respective ones of the plurality of combination signal values; and calibration circuitry coupled to the synchronous signal detection circuitry, the controllable amplifier circuitry and the controllable filter circuitry, and responsive to the error signal by providing the plurality of amplifier control signals and the plurality of filter control signals such that the error signal, for each of the plurality of frequencies, is indicative of a minimum difference between the corresponding ones of the plurality of selectively filtered signals.

In accordance with another embodiment of the presently claimed invention, a synchronous detection and calibration system for a close-talking differential microphone array (CTDMA) includes:

input means for conveying a plurality of microphone signals each of which corresponds to a source audio signal having a plurality of frequencies;

controllable amplifier means for responding to a plurality of amplifier control signals and the plurality of microphone signals by providing a plurality of selectively amplified signals at each of the plurality of frequencies;

controllable filter means for responding to a plurality of filter control signals and the plurality of selectively amplified signals by providing a plurality of selectively filtered signals at each of the plurality of frequencies;

signal combiner means for responding to the plurality of selectively filtered signals by providing a combination signal at each of the plurality of frequencies, wherein the combination signal has a plurality of values each of which is related to a difference between corresponding ones of the plurality of selectively filtered signals;

synchronous signal detector means for responding to one of the plurality of microphone signals and the combination signal by providing an error signal indicative of respective ones of the plurality of combination signal values; and calibration means for responding to the error signal by providing the plurality of amplifier control signals and the plurality of filter control signals such that the error signal, for each of the plurality of frequencies, is indicative of a minimum difference between the corresponding ones of the plurality of selectively filtered signals.

In accordance with another embodiment of the presently claimed invention, a synchronous detection and calibration system for a close-talking differential microphone array (CT-DMA) includes:

a plurality of input electrodes to convey a plurality of microphone signals, including a selected input electrode to convey a selected microphone signal, wherein each one of the plurality of microphone signals corresponds to a source audio signal having a plurality of frequencies;

first controllable amplifier circuitry coupled to at least one of the plurality of input electrodes and responsive to at least a first amplifier control signal and at least one the plurality of microphone signals by providing at least a first selectively amplified signal at each of the plurality of frequencies;

second controllable amplifier circuitry coupled to the first controllable amplifier circuitry and responsive to at least a second amplifier control signal and the first selectively amplified signal by providing a second selectively amplified signal at each of the plurality of frequencies;

signal combining circuitry coupled to the selected input electrode and the second controllable amplifier circuitry, and responsive to the selected microphone signal and the second selectively amplified signal by providing a combination signal at each of the plurality of frequencies, wherein the combination signal has a plurality of values each of which is related to a difference between corresponding ones of the selected microphone signal and second selectively amplified signal;

synchronous signal detection circuitry coupled to the selected input electrode and the signal combining circuitry, and responsive to the selected microphone signal and the combination signal by providing an error signal indicative of respective ones of the plurality of combination signal values; and calibration circuitry coupled to the synchronous signal detection circuitry, the first controllable amplifier circuitry and the second controllable amplifier circuitry, and responsive to the error signal by providing the at least a first amplifier control signal and the at least a second amplifier control signal such that the error signal, for each of the plurality of frequencies, is indicative of a minimum difference between the corresponding ones of the selected microphone signal and second selectively amplified signal.

In accordance with another embodiment of the presently claimed invention, a synchronous detection and calibration system for a close-talking differential microphone array (CT-DMA) includes:

input means for conveying a plurality of microphone signals, including a selected input electrode to convey a selected microphone signal, wherein each one of the plurality of microphone signals corresponds to a source audio signal having a plurality of frequencies;

first controllable amplifier means for responding to at least a first amplifier control signal and at least one the plurality of microphone signals by providing at least a first selectively amplified signal at each of the plurality of frequencies;

second controllable amplifier means for responding to at least a second amplifier control signal and the first selectively amplified signal by providing a second selectively amplified signal at each of the plurality of frequencies;

signal combiner means for responding to the selected microphone signal and the second selectively amplified signal by providing a combination signal at each of the plurality of frequencies, wherein the combination signal has a plurality of values each of which is related to a difference between corresponding ones of the selected microphone signal and second selectively amplified signal;

synchronous signal detector means for responding to the selected microphone signal and the combination signal by providing an error signal indicative of respective ones of the plurality of combination signal values; and calibration means for responding to the error signal by providing the at least a first amplifier control signal and the at least a second amplifier control signal such that the error signal, for each of the plurality of frequencies, is indicative of a minimum difference between the corresponding ones of the selected microphone signal and second selectively amplified signal.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

Figure 1:
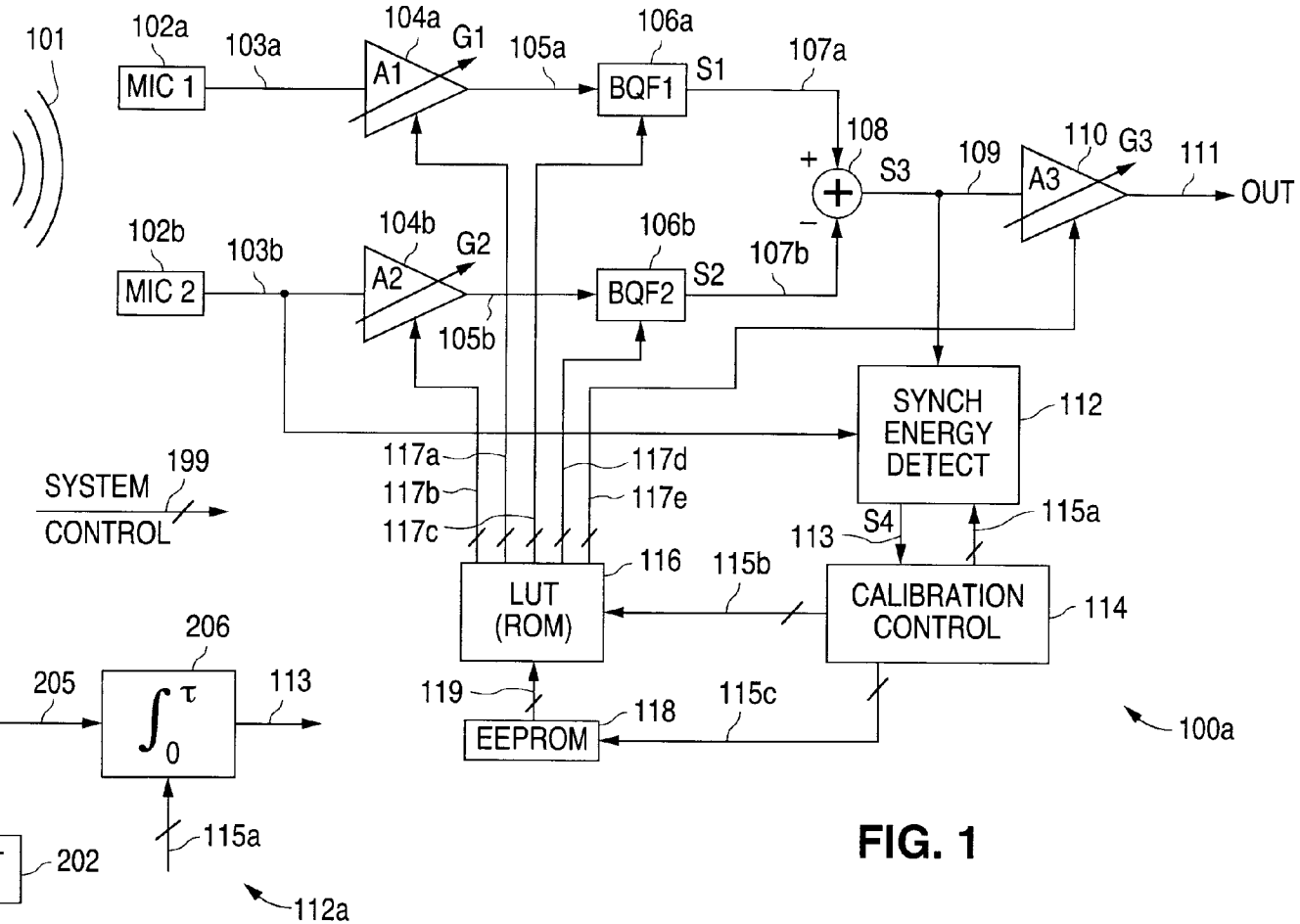
FIG. 1 is a functional block diagram of a synchronous detection and calibration system in accordance with one embodiment of the presently claimed invention.

Referring to FIG. 1, a synchronous detection and calibration system 100*a* in accordance with one embodiment of the presently claimed invention processes audio signals received form acoustic sensors in the form of microphones based upon calibration data generated in accordance with the presently claimed invention. This system 100*a* includes microphones 102*a*, 102*b*, variable gain amplifiers 104*a*, 104*b*, biquad filters 106*a*, 106*b*, summing circuitry 108, a synchronous energy detector 112, a calibration controller 114, a lookup table (e.g., a read only memory) 116, and a programmable memory (e.g., an electrically erasable programmable read only memory) 118, all interconnected substantially as shown.

During normal operation, incoming acoustic signals 101 are received by the microphones 102*a*, 102*b* and converted to corresponding electrical signals 103*a*, 103*b*. These signals 103*a*, 103 are amplified with variable gain amplifiers 104*a*, 104*b*, the gains for which are controlled in accordance with control signals 117*a*, 117*b* from the lookup table 116. The resulting amplified signals 105*a*, 105*b* are filtered by the biquad filters 106*a*, 106*b*, the characteristics (e.g., gain Gn, center frequency Fc and quality factor Q) are controlled in accordance with additional control signals 117*c*, 117*d* from the lookup table 116. The filtered signals 107*a*, 107*b* are differentially summed in the summing circuit 108. The resulting sum signal 109 is further amplified with a variable gain amplifier 110, the gain for which is controlled in accordance with another control signal 117*e* from the lookup table 116 (e.g., to compensate for other losses elsewhere within the host system) to produce the final output signal 111.

During calibration of the system 100*a*, a series of sequential tones are provided as the acoustic signals 101, e.g., from a loudspeaker. In accordance with one embodiment, three test tones are used, e.g., 300, 1,000 and 3,000 Hertz. However, any number of tones at any desired frequency can be used for calibrating this system 100*a*. During calibration, the center frequencies of the biquad filters 106*a*, 106*b* are set to the frequency of the test tone being used at that time, and the degree of frequency dependent gain is necessarily set to a minimum to avoid altering the frequency dependent gain mismatch realized between any chosen pair of aforesaid microphones. The sum signal 109, which serves as an error signal (i.e., the difference between the filtered signals 107*a*, 107*b*), is processed by the synchronous energy detector 112 in synchronization with one of the incoming microphone signals 103*b* (discussed in more detail below).

While monitoring the processed error signal 113, the calibration controller 114 provides control signals 115*b* to the lookup table 116 so as to cause appropriate control signals 117*a*, 117*b* to be provided to one or both of the variable gain amplifiers 104*a*, 104*b* such that the magnitude of the processed error signal 113, which corresponds to the input error signal 109, to be minimized. This operation is performed for each of the test tones. (The control data for the control signals 117*a*, 117*b*, 117*c*, 117*d* is based on prior characterization or testing of the system 100*a* and has been preprogrammed into the lookup table 116.)

Following completion of these tests, i.e., after the appropriate gain control data 117*a*, 117*b* have been determined for minimizing the error signal 109 at each test tone, the corresponding control data 115*b* are provided as index data 115*c* to the programmable memory 118. This index data 115*c* is stored in the programmable memory 118 for later use as the control data 119 for the lookup table during normal operation of the system 100*a*. As will be readily understood by one of ordinary skill in the art, coordination and timing of all operations are controlled using system control data 199 provided by a host system controller (not shown).

Figure 2:
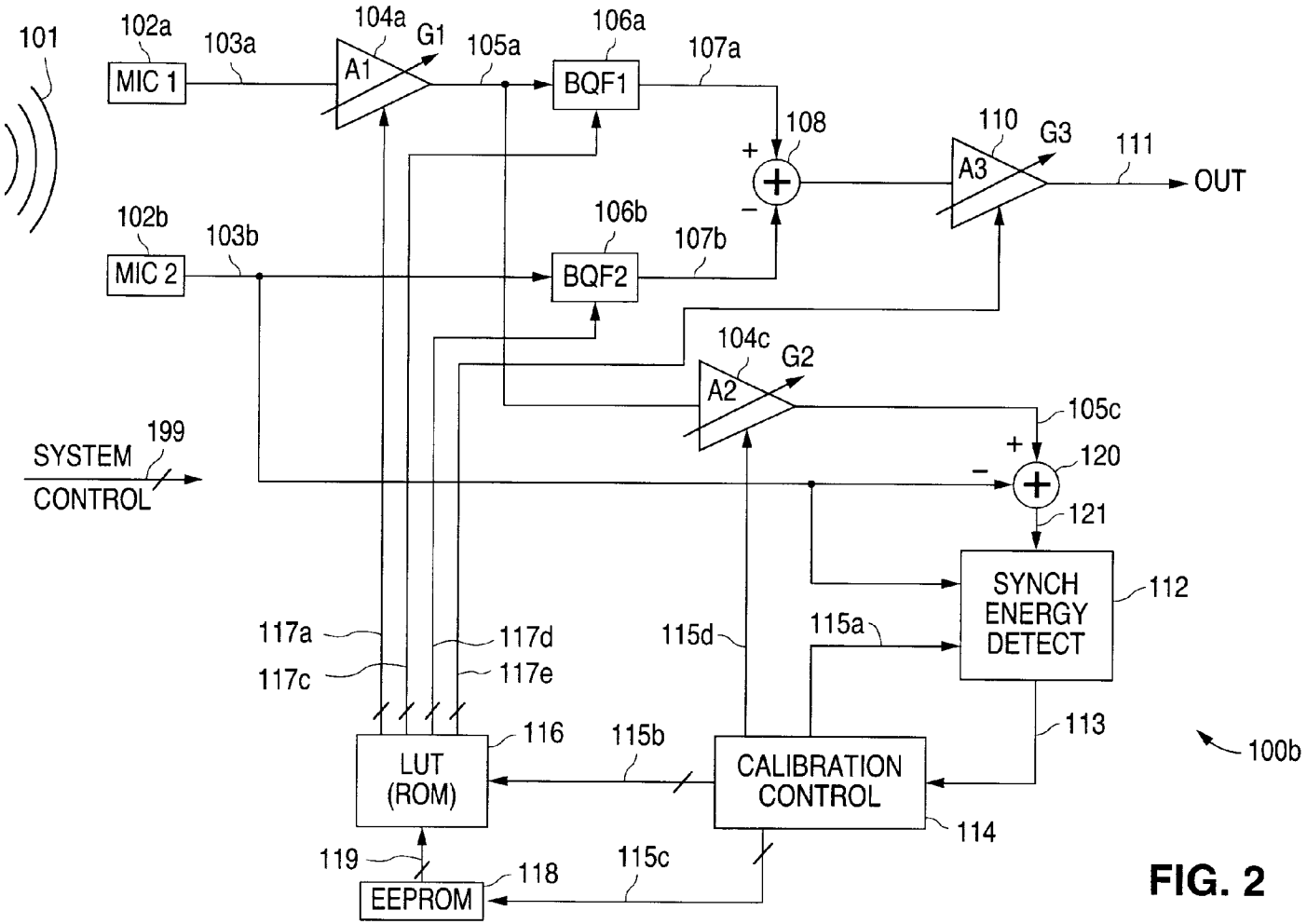
FIG. 2 is a functional block diagram of a synchronous detection and calibration system in accordance with another embodiment of the presently claimed invention.

Referring to FIG. 2, an alternative embodiment 100*b* includes most elements of the system of 100*a* of FIG. 1, plus a variable gain calibration amplifier 104*c* and summing circuit 120, all interconnected substantially as shown. In this embodiment 100*b*, one of the amplified microphone signals 105*a* is further amplified by the calibration amplifier 104*c* in accordance with control signals 115*d* from the calibration controller 114. The resulting amplified signal 105*c* is differentially summed with the other microphone signal 103*b* to produce the error signal 121 to be processed by the synchronous energy detector 112. During calibration, the center frequencies of the biquad filters 106*a*, 106*b* are set to the frequency of the test tone being processed at the time, and the gain G2 of the calibration amplifier 104*c* is set and maintained at a predetermined value (e.g., zero decibels). In this system 100*b*, an odd number of test tones are used, with the middle test tone applied first.

Applying the middle test tone (e.g., 1,000 Hertz), the error signal 121 is minimized by varying the gain G1 of the input amplifier 104*a* in accordance with its control data 117*a*, as selected by the control data 115*b* from the calibration controller 114 based on the processed error signal 113, as discussed above. The gain G1 at which the error signal 121 is minimized is maintained for subsequent testing using the remaining test tones (e.g., 300 and 3,000 Hertz). The remaining test tones are then applied sequentially, as discussed above, with the gain G2 of the calibration amplifier 104*c* now being controlled, in accordance with its control data 115*d*, to minimize the error signal 121 for each test tone. Based upon these tests, a gain G2 of the calibration amplifier 104*c* can be determined that provides for minimization of the error signal 121 for all test tones other than the middle test tone. This gain value G2 can then be mapped into corresponding appropriate gain values for amplifiers within the biquad filters 106*a*, 106*b* by selecting the appropriate control data 117*c*, 117*d* within the lookup table 116.

Following completion of these calibration tests using the test tones, the calibration control data 115*b* which produces the desired control data 117*a*, 117*c*, 117*d* for the input amplifier 104*a* and biquad filters 106*a*, 106*b*, as discussed above, is provided as index data 115*c* to the programmable memory 118 for storage and use as control data 119 for the lookup table 116 during normal operation of the system 100*b*.

Figure 3:
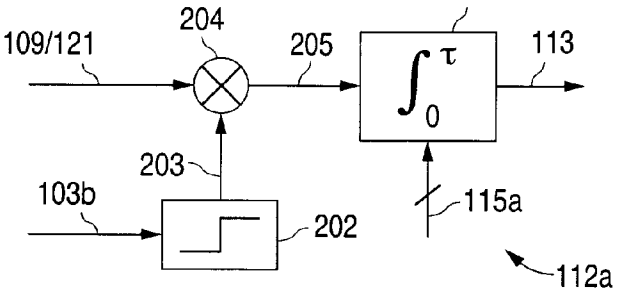
FIG. 3 is a functional block diagram of one example embodiment of a synchronous energy detector suitable for use in the systems of FIGS. 1 and 2.

Referring to FIG. 3, one example embodiment 112*a* of the synchronous energy detector can be implemented using a limiter (e.g., a signal slicer) 202, a signal multiplier (e.g., a mixer) 204, and a signal integrator 206, interconnected substantially as shown. The microphone signal 103*b* used for synchronizing the detector 112*a* is limited by the limiter 202. The limited signal 203 is multiplied with the error signal 109/121 to produce a product signal 205 that is independent of polarity changes in the original input signals 107*a*, 107*b* (FIG. 1), 105*c*, 103*b* (FIG. 2) that produce the error signal 109/121. The polarity of the product signal 205 is determined by the relative magnitudes of the original input signals 107*a*, 107*b*, 105*c*, 103*b*, which reflect the mismatches in the input sensors 102*a*, 102*b*. Accordingly, by analyzing the product signal 205 at various gain steps, as discussed above, the degree of mismatch between the sensors 102*a*, 102*b* can be determined.

To track the polarity of the product signal 205 more effectively, it is integrated within the integrator 206 which attenuates random variations and circuit noise present within the product signal 205. This integrator 206 operates in a periodic manner in accordance with the control data 115*a* from the calibration controller 114, with the duration of each integration cycle being controlled by the calibration controller 114 (e.g., in accordance with an oscillator). At the beginning of each test cycle, the gain steps are established, as discussed above, and the output 113 of the integrator 206 is reset to a predetermined value (e.g., zero). The product signal 205 is then integrated throughout the remainder of the test cycle. As discussed above, these test cycles are repeated until the optimum gain steps are determined.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a synchronous detection and calibration system for a close-talking differential microphone array (CTDMA), comprising:

a plurality of input electrodes to convey a plurality of microphone signals each of which corresponds to a source audio signal having a plurality of frequencies;

controllable amplifier circuitry coupled to said plurality of input electrodes and responsive to a plurality of amplifier control signals and said plurality of microphone signals by providing a plurality of selectively amplified signals at each of said plurality of frequencies;

controllable filter circuitry coupled to said controllable amplifier circuitry and responsive to a plurality of filter control signals and said plurality of selectively amplified signals by providing a plurality of selectively filtered signals at each of said plurality of frequencies;

signal combining circuitry coupled to said controllable filter circuitry and responsive to said plurality of selectively filtered signals by providing a combination signal at each of said plurality of frequencies, wherein said combination signal has a plurality of values each of which is related to a difference between corresponding ones of said plurality of selectively filtered signals;

synchronous signal detection circuitry coupled to one of said plurality of input electrodes and said signal combining circuitry, and responsive to one of said plurality of microphone signals and said combination signal by providing an error signal indicative of respective ones of said plurality of combination signal values; and calibration circuitry coupled to said synchronous signal detection circuitry, said controllable amplifier circuitry and said controllable filter circuitry, and responsive to said error signal by providing said plurality of amplifier control signals and said plurality of filter control signals such that said error signal, for each of said plurality of frequencies, is indicative of a minimum difference between said corresponding ones of said plurality of selectively filtered signals.

2. The apparatus of claim 1, wherein said synchronous signal detection circuitry comprises:

signal limiter circuitry coupled to said one of said plurality of input electrodes and responsive to said one of said plurality of microphone signals by providing a magnitude limited signal;

signal mixing circuitry coupled to said signal combining circuitry and said signal limiter circuitry, and responsive to said combination signal and said magnitude limited signal by providing a mixed signal; and signal integration circuitry coupled to said signal mixing circuitry and responsive to at least said mixed signal by providing said error signal.

3. The apparatus of claim 1, wherein said calibration circuitry comprises:

control circuitry coupled to said synchronous signal detection circuitry and responsive to said error signal by providing first and second pluralities of control data;

system data storage circuitry coupled to said control circuitry, said controllable amplifier circuitry and said controllable filter circuitry, and responsive to said first plurality of control data and a plurality of index data by accessing a plurality of system data stored therein to provide said plurality of amplifier control signals and said plurality of filter control signals; and index data storage circuitry coupled to said control circuitry and said system data storage circuitry, and responsive to said second plurality of control data by providing said plurality of index data.

4. The apparatus of claim 3, wherein said system data storage circuitry comprises read only memory circuitry.

5. The apparatus of claim 3, wherein said index data storage circuitry comprises electrically programmable memory circuitry.

6. An apparatus including a synchronous detection and calibration system for a close-talking differential microphone array (CTDMA), comprising:

input means for conveying a plurality of microphone signals each of which corresponds to a source audio signal having a plurality of frequencies;

controllable amplifier means for responding to a plurality of amplifier control signals and said plurality of microphone signals by providing a plurality of selectively amplified signals at each of said plurality of frequencies;

controllable filter means for responding to a plurality of filter control signals and said plurality of selectively amplified signals by providing a plurality of selectively filtered signals at each of said plurality of frequencies;

signal combiner means for responding to said plurality of selectively filtered signals by providing a combination signal at each of said plurality of frequencies, wherein said combination signal has a plurality of values each of which is related to a difference between corresponding ones of said plurality of selectively filtered signals;

synchronous signal detector means for responding to one of said plurality of microphone signals and said combination signal by providing an error signal indicative of respective ones of said plurality of combination signal values; and calibration means for responding to said error signal by providing said plurality of amplifier control signals and said plurality of filter control signals such that said error signal, for each of said plurality of frequencies, is indicative of a minimum difference between said corresponding ones of said plurality of selectively filtered signals.

7. An apparatus including a synchronous detection and calibration system for a close-talking differential microphone array (CTDMA), comprising:

a plurality of input electrodes to convey a plurality of microphone signals, including a selected input electrode to convey a selected microphone signal, wherein each one of said plurality of microphone signals corresponds to a source audio signal having a plurality of frequencies;

first controllable amplifier circuitry coupled to at least one of said plurality of input electrodes and responsive to at least a first amplifier control signal and at least one said plurality of microphone signals by providing at least a first selectively amplified signal at each of said plurality of frequencies;

second controllable amplifier circuitry coupled to said first controllable amplifier circuitry and responsive to at least a second amplifier control signal and said first selectively amplified signal by providing a second selectively amplified signal at each of said plurality of frequencies;

signal combining circuitry coupled to said selected input electrode and said second controllable amplifier circuitry, and responsive to said selected microphone signal and said second selectively amplified signal by providing a combination signal at each of said plurality of frequencies, wherein said combination signal has a plurality of values each of which is related to a difference between corresponding ones of said selected microphone signal and second selectively amplified signal;

synchronous signal detection circuitry coupled to said selected input electrode and said signal combining circuitry, and responsive to said selected microphone signal and said combination signal by providing an error signal indicative of respective ones of said plurality of combination signal values; and calibration circuitry coupled to said synchronous signal detection circuitry, said first controllable amplifier circuitry and said second controllable amplifier circuitry, and responsive to said error signal by providing said at least a first amplifier control signal and said at least a second amplifier control signal such that said error signal, for each of said plurality of frequencies, is indicative of a minimum difference between said corresponding ones of said selected microphone signal and second selectively amplified signal.

8. The apparatus of claim 7, wherein said synchronous signal detection circuitry comprises:

signal limiter circuitry coupled to said selected input electrode and responsive to said selected microphone signal by providing a magnitude limited signal;

signal mixing circuitry coupled to said signal combining circuitry and said signal limiter circuitry, and responsive to said combination signal and said magnitude limited signal by providing a mixed signal; and signal integration circuitry coupled to said signal mixing circuitry and responsive to at least said mixed signal by providing said error signal.

9. The apparatus of claim 7, wherein said calibration circuitry comprises:

control circuitry coupled to said synchronous signal detection circuitry and said second controllable amplifier circuitry, and responsive to said error signal by providing first and second pluralities of control data and said at least a second amplifier control signal;

system data storage circuitry coupled to said control circuitry and said first controllable amplifier circuitry, and responsive to said first plurality of control data and a plurality of index data by accessing a plurality of system data stored therein to provide said at least a first amplifier control signal; and index data storage circuitry coupled to said control circuitry and said system data storage circuitry, and responsive to said second plurality of control data by providing said plurality of index data.

10. The apparatus of claim 9, wherein said system data storage circuitry comprises read only memory circuitry.

11. The apparatus of claim 9, wherein said index data storage circuitry comprises electrically programmable memory circuitry.

12. An apparatus including a synchronous detection and calibration system for a close-talking differential microphone array (CTDMA), comprising:

input means for conveying a plurality of microphone signals, including a selected input electrode to convey a selected microphone signal, wherein each one of said plurality of microphone signals corresponds to a source audio signal having a plurality of frequencies;

first controllable amplifier means for responding to at least a first amplifier control signal and at least one said plurality of microphone signals by providing at least a first selectively amplified signal at each of said plurality of frequencies;

second controllable amplifier means for responding to at least a second amplifier control signal and said first selectively amplified signal by providing a second selectively amplified signal at each of said plurality of frequencies;

signal combiner means for responding to said selected microphone signal and said second selectively amplified signal by providing a combination signal at each of said plurality of frequencies, wherein said combination signal has a plurality of values each of which is related to a difference between corresponding ones of said selected microphone signal and second selectively amplified signal;

synchronous signal detector means for responding to said selected microphone signal and said combination signal by providing an error signal indicative of respective ones of said plurality of combination signal values; and calibration means for responding to said error signal by providing said at least a first amplifier control signal and said at least a second amplifier control signal such that said error signal, for each of said plurality of frequencies, is indicative of a minimum difference between said corresponding ones of said selected microphone signal and second selectively amplified signal.

* * * * *